US006216371B1

(12) United States Patent
Kim

(10) Patent No.: US 6,216,371 B1
(45) Date of Patent: Apr. 17, 2001

(54) REVOLVING SIGNBOARD FOR CONVEYING MULTIPLE MESSAGES

(76) Inventor: Yong Up Kim, 489 Apkujung-dong, Hanyang Apt. 36 - 903, Kangnam-ku, Seoul (KR)

( * ) Notice: Subject to any disclaimer, the term of this patent is extended or adjusted under 35 U.S.C. 154(b) by 0 days.

(21) Appl. No.: 09/247,064

(22) Filed: Feb. 9, 1999

(51) Int. Cl.[7] ..... G09F 11/02
(52) U.S. Cl. ..... 40/503; 40/524; 40/505
(58) Field of Search ..... 40/503, 505, 472, 40/524

(56) References Cited

U.S. PATENT DOCUMENTS

| | | | | |
|---|---|---|---|---|
| 844,344 | * | 2/1907 | Fletcher | 40/472 |
| 1,256,645 | * | 2/1918 | Barnett | 40/505 |
| 1,753,203 | * | 4/1930 | Hoetger | 40/472 |
| 1,802,725 | * | 4/1931 | Larcher | 40/472 X |
| 2,238,177 | * | 4/1941 | Marks, Jr. et al. | 40/472 |
| 2,266,676 | * | 12/1941 | Carter | 40/472 |
| 3,299,551 | * | 1/1967 | Llobet | 40/472 |

FOREIGN PATENT DOCUMENTS

| | | | | |
|---|---|---|---|---|
| 2382729 | * | 11/1978 | (FR) | 40/472 |
| 2626398 | * | 7/1989 | (FR) | 40/524 |

* cited by examiner

*Primary Examiner*—Joanne Silbermann
(74) *Attorney, Agent, or Firm*—Birch, Stewart, Kolasch & Birch, LLP

(57) ABSTRACT

A revolving signboard for conveying multiple messages, which comprises a housing having at least one window provided therein, a conveying system rotatably disposed within said housing, including means for rotating said conveying system in opposite directions, a plurality of pillars rotatably connected to said conveying signboard by connecting elements, each of said pillars containing a plurality of surfaces for selective exposure through the window of said housing, and a stopping pin mounted in said housing and an engaging member opratively associated with said pillars to engage with said stopping pin for rotating the pillar from one surface to an adjacent surface.

11 Claims, 4 Drawing Sheets

REVOLVING SIGNBOARD FOR CONVEYING MULTIPLE MESSAGES

BACKGROUND OF THE INVENTION

1. Field of the Invention

The present invention relates to a revolving signboard for conveying multiple messages and more particularly to an improved rotary signboard which incluees a plurality of faces, e.g. square or rectangular faces, which rotate for conveying multiple messages or images. Advantageously, the signboard can comprise a plurality of square pillars which rotate for conveying multiple messages.

2. Description of Relates Art

Various types of revolving signboards are known in the art. Generally, if the structure of a conventional revolving signboard is simple, such a conventional revolving signboard cannot convey multiple messages. However, since the structure of such a conventional signboard is complicated, it is expensive to manufacture, difficult in use and ugly in appearance.

A conventional triangular prism-type signboard is known in the art; that is, a signboard which has thrree faces for conveying three seprate massages. However, since such a conventional triangular prism-type signboard revolves 120° independently or rotates in regular order, it cannot convey more than three messages.

SUMMARY OF THE INVENTION

Accordingly, it is an object of the present invention to provide an improved revolving signboard for conveying multiple messages which eliminates the above problems encountered with conventional revolving signboards.

Another object of the present invention is to provide a revolving signboard which includes a plurality of square pillars, a conveying system, for example, a linked chain having a pair of gears and a two-way motor whereby upon operating the motor, the square pillars are moved by the chain for exposing one face thereof, and the pillars rotate 90° in one revolution of the chain for exposing another face thereof, whereby the revolving signboard of the present invention is capable of conveying multiple messages. Also, since the motor operates in a two-way direction, i.e., in a clockwise and counterclockwise direction, the face can be changed from bottom to top or from top to bottom for conveying multiple messages.

A further object of the present invention is to provide a revolving signboard for conveying multiple messages which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modficiations within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 3:
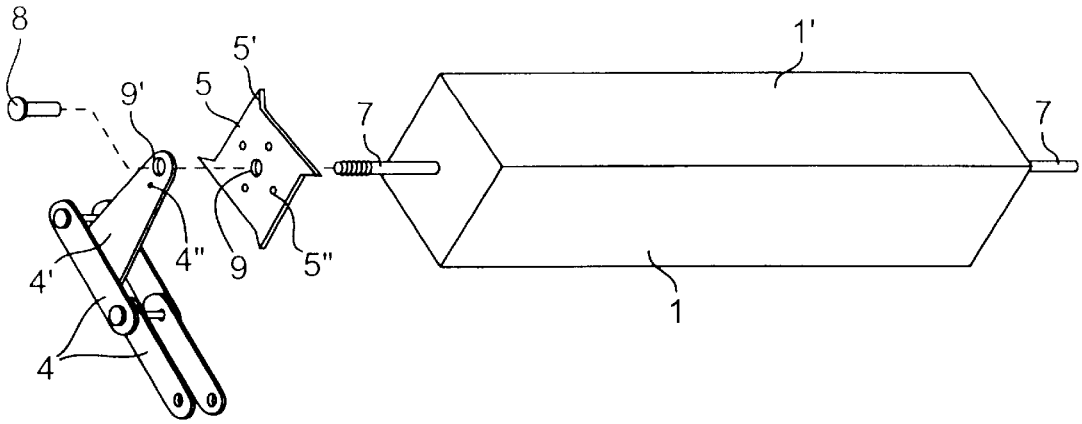
FIG. 3 is an exploded perspective view of a square pillar of the revolving signboard for conveying multiple messages according to the present invention.
Figure 4:
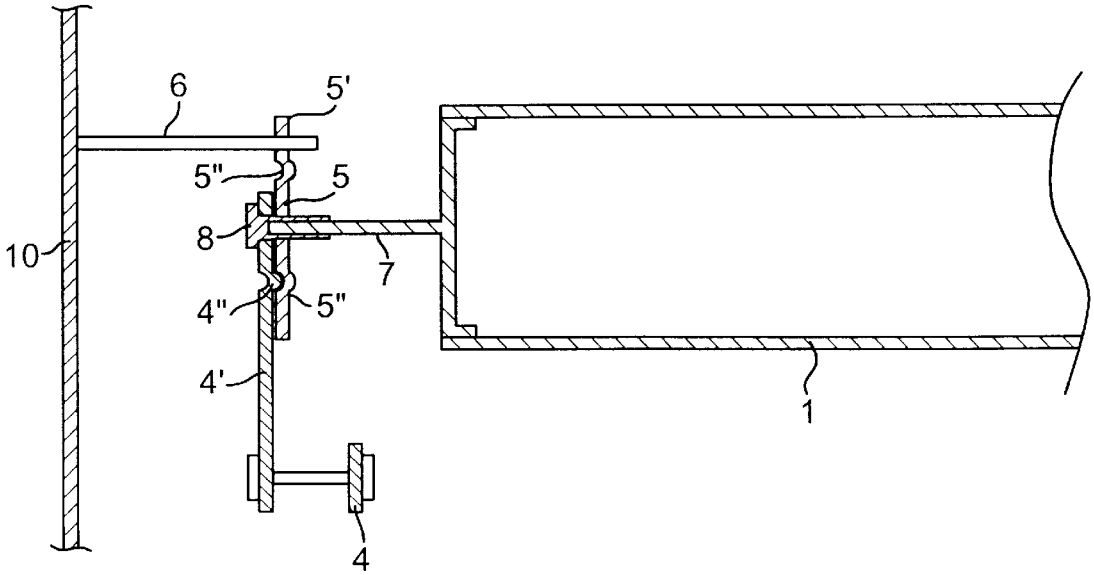
FIG. 4 is a sectional view of FIG. 3.
Figure 5:
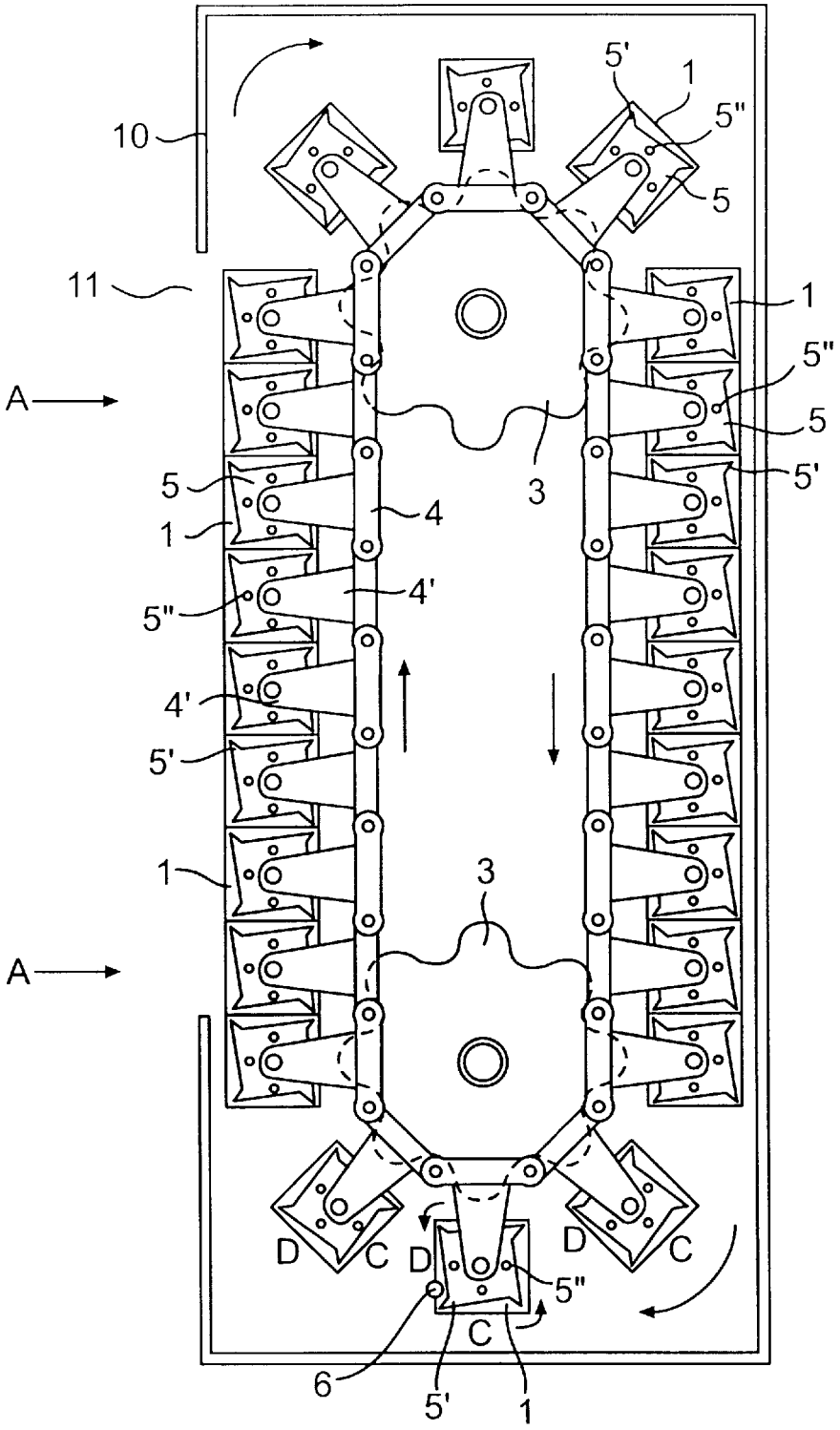
FIG. 5 is a top plan view of the revolving signboard containing a cutaway portion for illustrating the operation thereof according to the present invention.

Referring now in detail to the drawings for the purpose of illustrating preferred embodiments of the present invention, the revolving signboard for conveying multiple messages as shown in FIGS. 1 to 4 includes a housing 10 and a plurality of pillars, e.g., square pillars, connected at their ends to a chain link conveying system 4 disposed within the housing 10. A stopping pin 6 is mounted to the interior of the housing 10 in the turnaround zone for rotating the square pillars 90°. The two-way motor 20 rotates the chain link 1 through the use of a pair of gears 3 (FIG. 5). Also, the housing contains an opening 11 disposed at the front area (A) and can also contain an opening 11 disposed at the rear area (FIG. 5).

Figure 2:
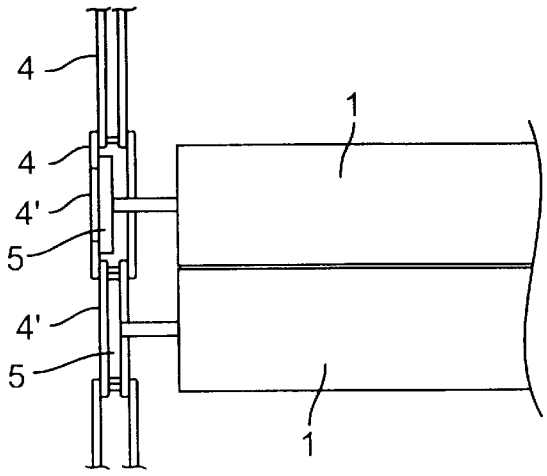
FIG. 2 is an enlarged front elevational view of a portion of the revolving signboard for conveying multiple messages according to the present invention.

As shown in FIGS. 2 and 3, each of the square pillars 1 includes four faces, with shafts 7 which extend from the top and bottom thereof. Each of the shafts 7 contains a square plate 5 having four raised or extended portions 5' disposed at four corners thereof. The plate 5 can be fixed to the shaft 7 using a bolt 8 which extends through a first aperture 9' in a connecting link 4' attached to the chain 4 and through a second aperture 9" provided in the plate 5. The bolt 8 can then be screwed to the end of the shaft 7, thereby fixing the square pillar to the chain.

A projection 4" of the connecting extension 4' is tightly and selectively engaged with one of four apertures or depressions 5" disposed on the outer surface of the rotatable square plate 5. As shown in FIGS. 4 and 5, as the chain 4 rotates 180° at one of the top and bottom areas where the stopping pin is located, the rotatable plate 5 rotates 90° and accordingly the square pillar 1 rotates 90° as a result of the engagement of the raised or extended portions 5' with the stopping pin 6. At this time, the projection 4" engages with the grove 5" of the rotatable square plate 5.

Figure 1:
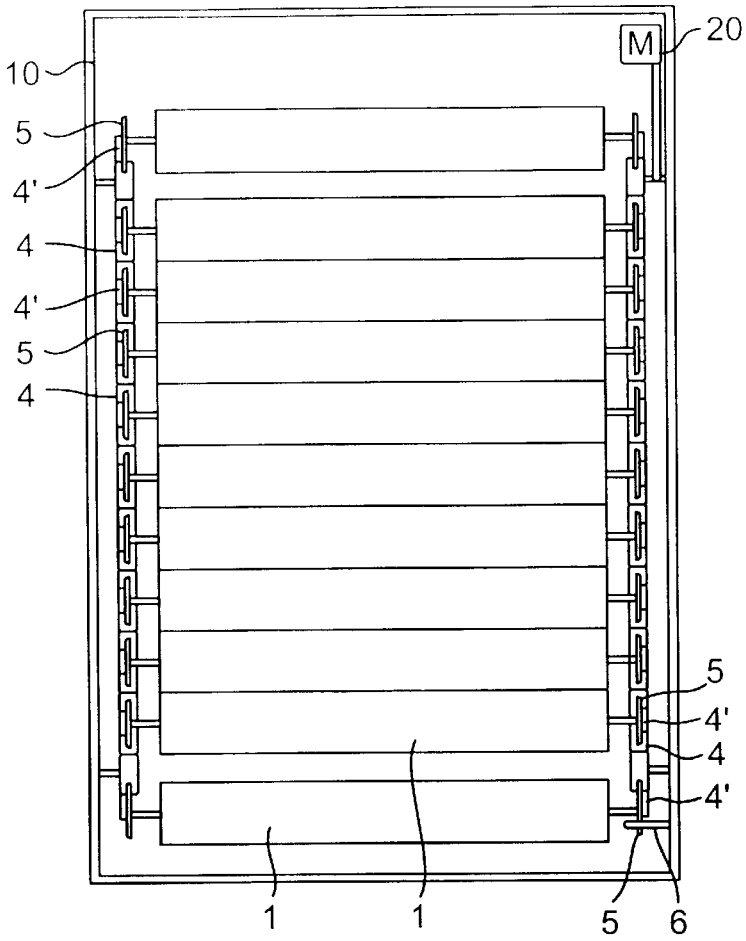
FIG. 1 is a front elevational view of a revolving signboard for conveying multiple messages according to the present invention.

As shown in FIGS. 5 and 6(A) to 6(D), the revolving signboard for conveying multiple messages according to the present invention operates as follows. As shown in FIG. 5 the square pillars move uniformly across the front area 11 at the opening (A) of the housing 10 as a composite structure comparable to a single square plate. Because the plurality of square pillars 1 are disposed close together in a side-by-side relationship, the eight square pillars 1 (FIG. 5) can be used to convey a multiplicity of signs and messages according to the desired combination of square pillars. The square pillars 1 revolve 90° at the bottom of the housing where the stopping pin 6 engages the extension 5' as shown in FIGS. 1 and 5. That is, the square pillrs 1 revolve at the bottom of the housing where the link chain 4 gears with the gears 3, as shown in FIG. 5.

Figure 6A:
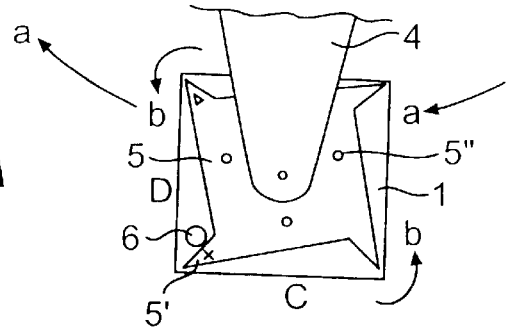
FIGS. 6(A), 6(B), 6(C) and 6(*d*) show a top view of the square pillars of the revolving signboard as they revolve 90° to replace a front face with an adjacent face of the square pillar.
Figure 6B:
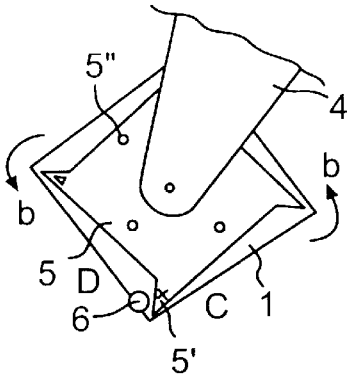
Figure 6C:
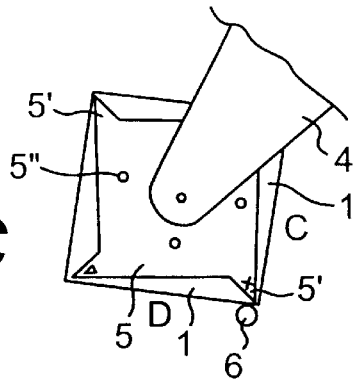
Figure 6D:
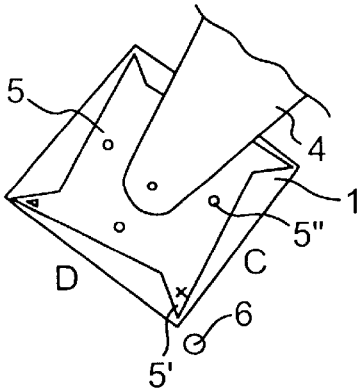

As shown in FIGS. 6(A) to 6(D), the rotary square plate 5 engages the stopping pin 6 for progressively changing face (C) of the square pillar 1, as shown in FIGS. 6(A) to face (D) as shown in FIGS. 6(B), 6(C) and 6(D). Thus, when the rotary square plate 5 engages the stopping pin 6, the square plate 5 revolves or rotates in stopping pin 6, the square plate 5 revolves or rotates in the direction indicated by the arrow (b) as shown in FIG. 6(B) while the connecting extension 4 revolves in the direction indicated by the arrow (a) as shown in FIG. 6(A). Thus, the square pillar 1 revolves in the countercockwise direction and, at the same time, the connecting extension 4 revolves in the clockwise direction. Therefore, after the square pillar 1 revolves 90°, the (D) face of the square pillar 1 is ready to function as a signboard as shown in FIG. 6(D). Accordingly, by rotating the link chain one cycle, the signboard changes from a message using the (C) faces to a different message using the (D) faces.

In order to rotate the square pillar 1 90°, the projection 4" is slidably engaged with the next groove 5" from the original groove 5" of the rotary square plate 5 as shown in FIG. 4.

The revolving signboard of the present invention is capable of conveying multiple messages since each square pillar contains four different faces when the pillar is rotates to its four different positions. For example, as shown in FIG. 5, since there are a total of twenty-four square pillars 1, they comprise ninety-six faces so that a total of ninety-six faces are avaialble for conveying a plurality of messages. Therefore, if so desired, one message can be conveyed on the ninety-six faces of the square pillars 1 or, alternatively, twenty-four messages can be conveyed on the four faces of the square pillars. At this time, each message can be stopped at a moment's notice by using a timer (not shown). In addition, each of the square pillars 1 can contain a fluorescent light or other type of lighting arrangement known in the art for illuminating the intended message.

In another aspect of the present invention, the stopping pin 6 can be selectively retractable whereby the accordance with a predesigned sequence as determined by an appropriate software program, thereby enabling the use of a multiplicity of permutations and combinations of faces leading to many possible display messages. Also, although a square pillar was used as exemplary of the present invention, it can be readily seen that triaangular pillars or multi-face pillars larger than four could be used by making other small accommodations to the overall system.

The revolving signboard for conveying multiple messages according to the present invnetion is simple in structure, inexpensive to manufacture, easy to use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A revolving signboard for conveying multiple messages, which comprises a housing having at least one window provided therein, a conveying system rotatably disposed within said housing, including means for rotating said conveying system in opposite directions, a plurality of pillars rotatably connected to said revolving signboard by connecting elements, each of said pillars containing a plurality of surfaces for selective exposure through the window of said housing, and a stopping pin mounted in said housing and an engaging member operatively associated with said pillars to engage with said stopping pin for rotating the pillar from one surface to an adjacent surface, the engaging member being an extension of an element attached to the pillar.

2. The revolving signboard of claim 1, wherein the pillars are square pillars, the plates are substantially square plates and the engaging members use extensions from the corners of the substantially square plates.

3. The revolving signboard of claim 1, wherein the plate is provided with a plurality of dimples or apertures and each of the connecting elements is provided with a projection whereby upon the rotation of the conveying system the projection slidably engages with a dimple or aperture to facilitate the partial rotation of the pillar, said remaining dimples or apertures engaging said projection in sequence for rotating said pillar through 360° as a result of multiple rotations of the conveying system.

4. The revolving signboard of claim 1, wherein the conveying system is a chain link system which rotates around a pair of spaced-apart gears, said plurality of pillars being mounted to said chain link conveying system by a connecting link.

5. The revolving signboard of claim 4, wherein the means for rotating the conveying system is a two-way motor.

6. The revolving signboard of claim 1, wherein each pillar has a square cross section and a rectangular configuration, thereby defining four surfaces for the conveying of multiple messages.

7. The revolving signboard of claim 1, wherein the housing has a pair of openings disposed on opposite sides from one another.

8. The revolving signboard of claim 1, wherein lighting means are operatively associated with said pillars for illuminating the message for night display.

9. The revolving signboard of claim 1, wherein the stopping pin is retractable for selectively rotating or not rotating the faces of each pillar, thereby increasing the possible combination of the pillar faces for presenting a plurality of display messages.

10. The revolving signboard of claim 9, wherein the stopping pin being selectively and automatically movable to positions into or out of engagement with the engagement member for selectively rotating or not rotating each pillar in accordance with messages to be displayed.

11. A revolving signboard for conveying multiple messages, which comprises a housing having at least one window provided therein, a conveying system rotatably disposed within said housing, including means for rotating said conveying system in opposite directions, a plurality of pillars rotatably connected to said revolving signboard by connecting elements, each of said pillars containing a plurality of surfaces for selective exposure through the window of said housing, and the stopping pin mounted in said housing and an engaging member operatively associated with said pillars to engage with said stopping pin for rotating the pillar from one surface to an adjacent surface, the stopping pin being selectively and automatically movable to positions into or out of engagement with the engagement member for selectively rotating or not rotating each pillar in accordance with messages to be displayed.

* * * * *